US005898951A

United States Patent [19]

Rakoz

[11] Patent Number: 5,898,951

[45] Date of Patent: May 4, 1999

[54] VENTILATED TOILET

[76] Inventor: Ken Rakoz, 11000 132nd Ave. N.E., Redmond, Wash. 98052

[21] Appl. No.: 09/054,252

[22] Filed: Apr. 2, 1998

[51] Int. Cl.[6] ..... A47K 13/00

[52] U.S. Cl. ..... 4/217

[58] Field of Search ..... 4/213, 216, 217

[56] References Cited

U.S. PATENT DOCUMENTS

| | | | |
|---|---|---|---|
| 2,079,733 | 5/1937 | Cummings | 4/213 |
| 3,335,431 | 8/1967 | Coates | 4/213 |
| 5,201,079 | 4/1993 | Sowards | 4/213 X |
| 5,454,122 | 10/1995 | Bergeron | 4/213 X |

*Primary Examiner*—Charles E. Phillips

[57] ABSTRACT

A toilet ventilating apparatus is provided including a toilet bowl having an annular upper edge. A hollow toilet seat is provided having a generally planar configuration with a top face, a bottom face and an inner periphery and an outer periphery. Both the inner periphery and the outer periphery are defined by a front portion, a rear portion, and a pair of side portions. The inner periphery has a plurality of equally spaced inlet apertures formed therein. The inlet apertures formed adjacent the front portion are of a greater size as compared to those formed in the rear portion of the inner periphery. A pair of hinges are connected between the toilet seat and the toilet bowl for allowing the toilet seat to be pivoted between a lowered and a raised orientation. Also included is a fan unit adapted suction air through the inlet apertures.

1 Claim, 3 Drawing Sheets

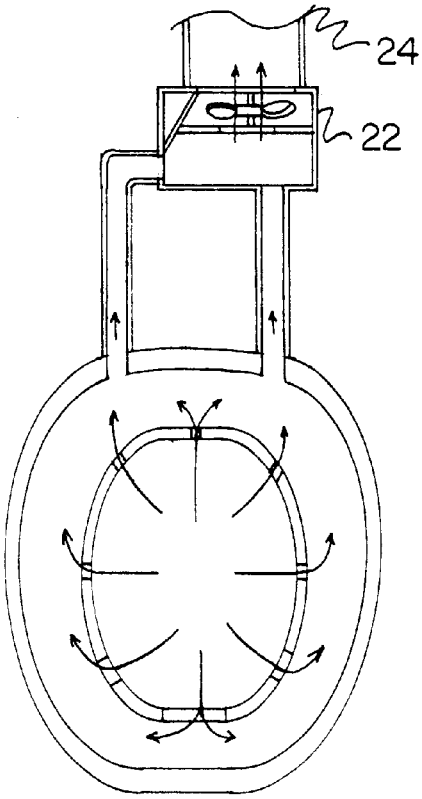
FIG. 3
FIG. 4
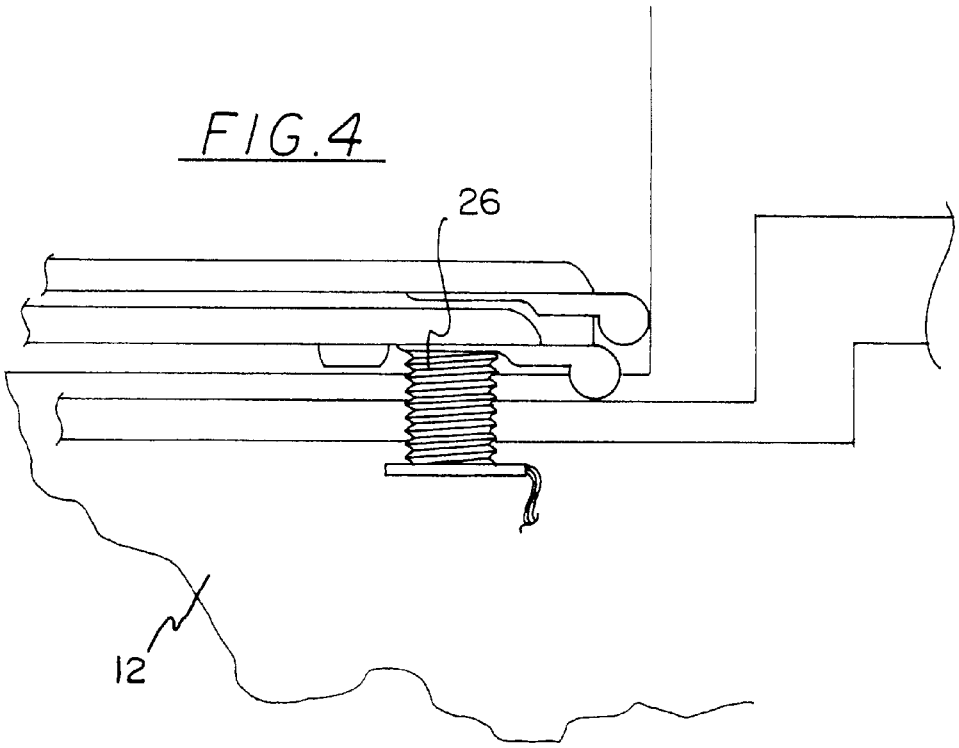

VENTILATED TOILET

BACKGROUND OF THE INVENTION

1. Field of the Invention

The present invention relates to bathroom ventilation systems and more particularly pertains to a new ventilated toilet for effectively removing odor from a toilet bowl.

2. Description of the Prior Art

The use of bathroom ventilation systems is known in the prior art. More specifically, bathroom ventilation systems heretofore devised and utilized are known to consist basically of familiar, expected and obvious structural configurations, notwithstanding the myriad of designs encompassed by the crowded prior art which have been developed for the fulfillment of countless objectives and requirements.

Known prior art bathroom ventilation systems include U.S. Pat. Nos. 4,993,083; 4,984,305; U.S. Pat. Des. No. 352,996; U.S. Pat. Nos. 5,054,131; 5,079,782; and 5,257,421.

In these respects, the ventilated toilet according to the present invention substantially departs from the conventional concepts and designs of the prior art, and in so doing provides an apparatus primarily developed for the purpose of effectively removing odor from a toilet bowl.

SUMMARY OF THE INVENTION

In view of the foregoing disadvantages inherent in the known types of bathroom ventilation systems now present in the prior art, the present invention provides a new ventilated toilet construction wherein the same can be utilized for effectively removing odor from a toilet bowl.

The general purpose of the present invention, which will be described subsequently in greater detail, is to provide a new ventilated toilet apparatus and method which has many of the advantages of the bathroom ventilation systems mentioned heretofore and many novel features that result in a new ventilated toilet which is not anticipated, rendered obvious, suggested, or even implied by any of the prior art bathroom ventilation systems, either alone or in any combination thereof.

To attain this, the present invention generally comprises a toilet bowl having an annular upper edge and a rectangular water basin mounted above and to the rear of the upper edge. In a first embodiment, a hollow toilet seat is provided having a generally planar configuration with a top face, a bottom face and an inner periphery and an outer periphery. The inner and outer peripheries are both defined by a front portion, a rear portion, and a pair of side portions. The inner periphery has a plurality of equally spaced inlet apertures formed therein. The inlet apertures formed adjacent the front portion are of a greater size as compared to those formed in the rear portion of the inner periphery for reasons that will soon become apparent. The rear portion of the outer periphery has a pair of straight, parallel & hollow outlet conduits integrally coupled thereto and extended rearwardly therefrom. Such conduits remain in coplanar relationship with the toilet seat and further in fluidic communication with the inlet apertures. Next provided is a pair of hinges each including a first hollow hemispherical portion integrally coupled to an end of an associated one of the outlet conduits. Note FIG. 6. Each hinge further has a second hollow hemispherical portion rotatably and sealingly coupled to the first hollow hemispherical portion for defining a full sphere. The second hollow hemispherical portion is mounted to the upper edge of the toilet seat. As such, the first hollow hemispherical portion and toilet seat are pivotable between a lowered and a raised orientation. For reasons that will soon become apparent, the second hollow hemispherical portion has an outlet adapter integrally coupled thereto and extended rearwardly therefrom. Mounted to the rear of the water basin of the toilet is a fan unit. The fan is situated within a vent having a first end situated distant the toilet bowl and a second end situated in communication with a pair of flexible tubes. Such flexible tubes are in turn connected to the outlet adapter of a corresponding one of the hinges. In operation, the fan unit is adapted suction air through the inlet apertures and out the first end of the vent during the actuation thereof.. Finally, an actuation switch is mounted to the upper edge of the toilet bowl below the bottom face of the toilet seat and adjacent to one of the associated hinges. The actuation switch is adapted for actuating the fan unit only upon the detection of a predetermined amount of weight situated thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ventilated toilet apparatus and method which has many of the advantages of the bathroom ventilation systems mentioned heretofore and many novel features that result in a new ventilated toilet which is not anticipated, rendered obvious, suggested, or even implied by any of the prior art bathroom ventilation systems, either alone or in any combination thereof.

It is another object of the present invention to provide a new ventilated toilet which may be easily and efficiently manufactured and marketed.

It is a further object of the present invention to provide a new ventilated toilet which is of a durable and reliable construction.

An even further object of the present invention is to provide a new ventilated toilet which is susceptible of a low cost of manufacture with regard to both materials and labor, and which accordingly is then susceptible of low prices of sale to the consuming public, thereby making such ventilated toilet economically available to the buying public.

Still yet another object of the present invention is to provide a new ventilated toilet which provides in the apparatuses and methods of the prior art some of the advantages thereof, while simultaneously overcoming some of the disadvantages normally associated therewith.

Still another object of the present invention is to provide a new ventilated toilet for effectively removing odor from a toilet bowl.

Even still another object of the present invention is to provide a new ventilated toilet that includes a toilet bowl having an annular upper edge. A hollow toilet seat is provided having a generally planar configuration with a top face, a bottom face and an inner periphery and an outer periphery. Both the inner periphery and the outer periphery are defined by a front portion, a rear portion, and a pair of side portions. The inner periphery has a plurality of equally spaced inlet apertures formed therein. The inlet apertures formed adjacent the front portion are of a greater size as compared to those formed in the rear portion of the inner periphery. A pair of hinges are connected between the toilet seat and the toilet bowl for allowing the toilet seat to be pivoted between a lowered and a raised orientation. Also included is a fan unit adapted suction air through the inlet apertures.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a top cross-sectional view of the embodiment of the present invention shown in FIG. 1.

FIG. 4 is a side view of the actuation switch of the present invention.

DESCRIPTION OF THE PREFERRED EMBODIMENT

Figure 1:
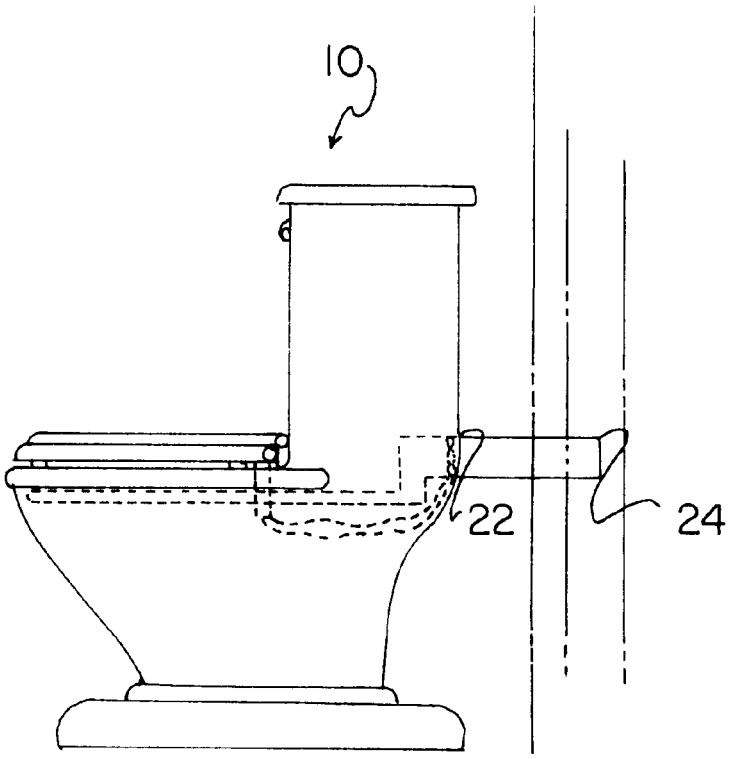
FIG. 1 is a side view of one of the embodiments of the present invention.
Figure 2:
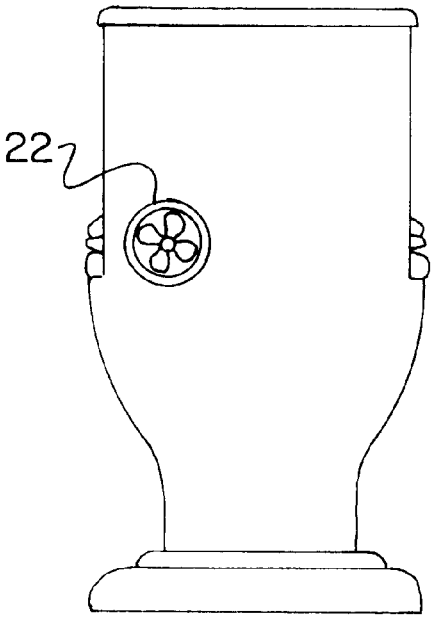
FIG. 2 is a rear view of the present invention.
Figure 5:
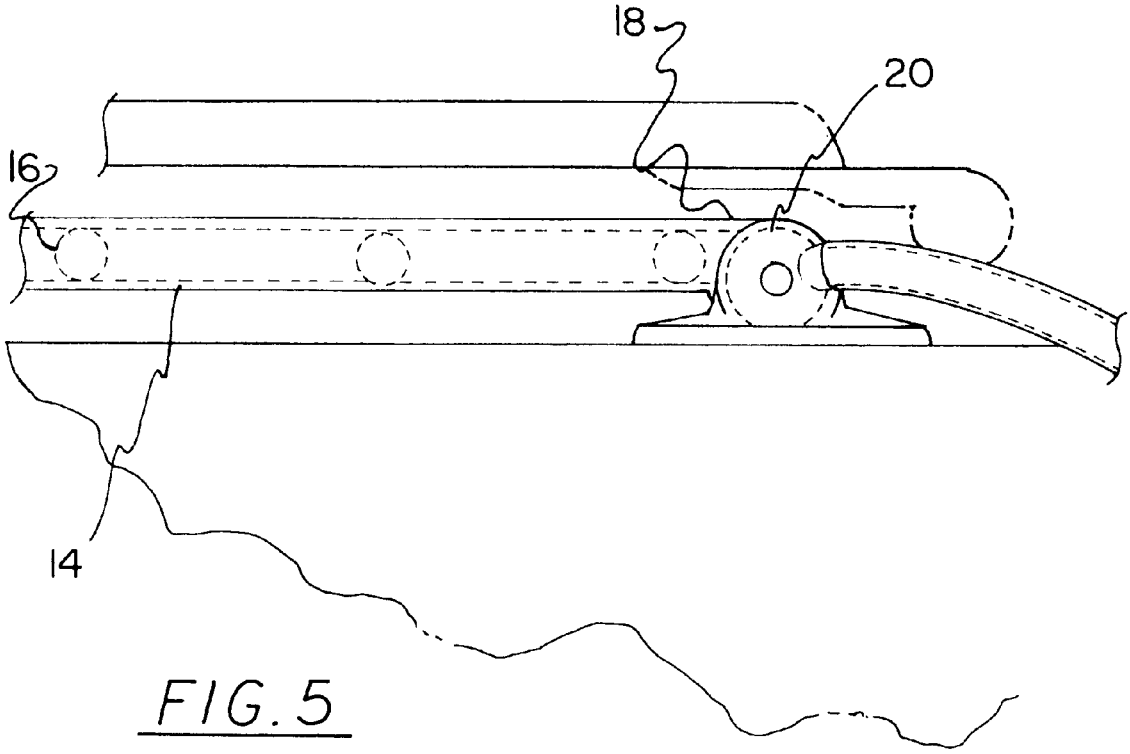
FIG. 5 is a side view of the present invention.

With reference now to the drawings, and in particular to FIGS. 1 through 6 thereof, a new ventilated toilet embodying the principles and concepts of the present invention and generally designated by the reference numeral 10 will be described.

The present invention, designated as numeral 10, includes a toilet bowl 12 having an annular upper edge and a rectangular water basin mounted above and to the rear of the upper edge.

In a first embodiment, a hollow toilet seat 14 is provided having a generally planar configuration with a top face, a bottom face and an inner periphery and an outer periphery. The inner and outer peripheries are both defined by a front portion, a rear portion, and a pair of side portions. The inner periphery has a plurality of equally spaced inlet apertures 16 formed therein. The inlet apertures formed adjacent the front portion are of a greater size as compared to those formed in the rear portion of the inner periphery for reasons that will soon become apparent. As shown in FIG. 3, the inlet apertures of the front portion of the inner periphery each ideally have a size which is at least twice that of the inlet apertures of the rear portion.

The rear portion of the outer periphery has a pair of straight, parallel & hollow outlet conduits 18 integrally coupled thereto and extended rearwardly therefrom. Such conduits remain in coplanar relationship with the toilet seat and further in fluidic communication with the inlet apertures.

Figure 6:
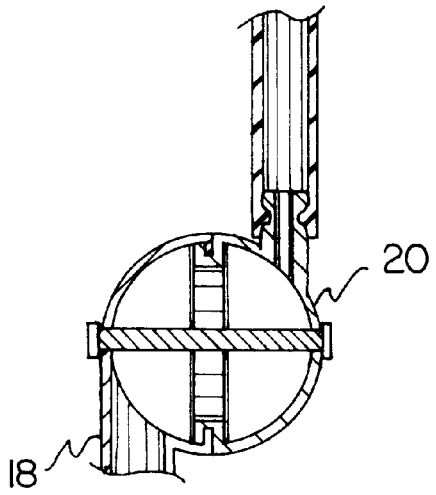
FIG. 6 is a cross-sectional view of one of the hinges of the present invention.

Next provided is a pair of hinges 20 each including a first hollow hemispherical portion integrally coupled to an end of an associated one of the outlet conduits. As shown in FIG. 6, the outlet conduits enter the corresponding hemispherical portion from a front end thereof. Each hinge further has a second hollow hemispherical portion rotatably and sealingly coupled to the first hollow hemispherical portion for defining a full sphere. To accomplish a seal, one of the portions has an annular indent while the other has an annular detent. To maintain the two portions together, a horizontal pin is preferably mounted between side apexes of the hemispherical portions.

The second hollow hemispherical portion is mounted to the upper edge of the toilet bowl. By this structure, the first hollow hemispherical portion and toilet seat are pivotable between a lowered and a raised orientation. For reasons that will soon become apparent, the second hollow hemispherical portion has an outlet adapter integrally coupled to a rear end thereof and extended rearwardly therefrom.

In another embodiment best shown in FIGS. 1 & 3, the inlet apertures may be simply mounted directly in the inner surface of the upper edge of the toilet bowl.

Mounted to the rear of the water basin of the toilet is a fan unit 22. The far, unit is situated within a vent 24 having a first end situated distant the toilet bowl and in communication with outside air. The vent further has a second end mounted to a rear of the water basin. The vent remains level with the toilet seat and is situated in communication with a pair of flexible tubes. Such flexible tubes are each in turn releasably connected to the outlet adapter of a corresponding one of the hinges.

As an option, only a single tube may be used to communicate with the outlet adapter of one of the hinges. Further, in the other embodiment best shown in FIGS. 1 & 3, the tubes may be situated within the toilet or formed integral therewith to communicate directly with the inlet apertures. In operation, the fan unit is adapted suction air through the inlet apertures and out the first end of the vent during the actuation thereof. It now becomes apparent that the specific size of the apertures is critical for ensuring that an even air flow is effected through the input apertures.

Finally, an actuation switch 26 is mounted to the upper edge of the toilet bowl below the bottom face of the toilet seat and adjacent to one of the associated hinges.- The actuation switch is adapted for actuating the fan unit only upon the detection of a predetermined amount of weight situated thereon. In an alternate embodiment, the weight sensor may be replaced with a motion sensor.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toilet ventilating apparatus comprising:

a toilet bowl having an annular upper edge and a rectangular water basin mounted above and to the rear of the upper edge;

a hollow toilet seat having a generally planar configuration with a top face, a bottom face and an inner periphery and an outer periphery both defined by a front portion, a rear portion, and a pair of side portions, the inner periphery having a plurality of equally spaced inlet apertures formed therein with the inlet apertures formed adjacent the front portion being of a greater size as compared to those formed in the rear portion of the inner periphery, the rear portion of the outer periphery having a pair of straight, parallel & hollow outlet conduits integrally coupled thereto and extending rearwardly therefrom in coplanar relationship with the toilet seat and in communication with the inlet apertures, wherein the inlet apertures of the front portion of the inner periphery have a size at least twice that of the inlet apertures of the rear portion;

a pair of hinges each including a first hollow hemispherical portion integrally coupled to an end of an associated one of the outlet conduits, a second hollow hemispherical portion rotatably and sealingly coupled to the first hollow hemispherical portion for defining a full sphere, wherein the second hollow hemispherical portion is mounted to the upper edge of the toilet bowl and the first hollow hemispherical portion and toilet seat are pivotable between a lowered and a raised orientation, the second hollow hemispherical portion having an outlet adapter integrally coupled thereto and extending rearwardly therefrom;

wherein one of the hollow hemispherical portions has an annular detent formed therein which is rotatable and sealingly engaged with an annular indent of another one of the hollow hemispherical portions with a horizontal pin rotatably connected between side apexes of the hemispherical portions:

a fan unit mounted to the rear of the water basin of the toilet and situated within a vent having a first end situated distant the toilet bowl and a second end situated in communication with a pair of flexible tubes which are in turn connected to the outlet adapter of a corresponding one of the hinges, the fan unit adapted to suction air through the inlet apertures and out the first end of the vent during the actuation thereof; and an actuation switch mounted to the upper edge of the toilet bowl below the bottom face of the toilet seat adjacent to one of the associated hinges for actuating the fan unit only upon the detection of a predetermined amount of weight situated on the toilet seat.

* * * * *